US008389847B2

(12) United States Patent
Matsuda

(10) Patent No.: US 8,389,847 B2
(45) Date of Patent: Mar. 5, 2013

(54) PIANO WITH ELECTRONIC TONE GENERATOR

(75) Inventor: Toshinori Matsuda, Shizuoka (JP)

(73) Assignee: Kabushiki Kaisha Kawai Gakki Seisakusho, Hamamatsu-Shi (JP)

( * ) Notice: Subject to any disclaimer, the term of this patent is extended or adjusted under 35 U.S.C. 154(b) by 0 days.

(21) Appl. No.: 13/420,098

(22) Filed: Mar. 14, 2012

(65) Prior Publication Data

US 2012/0247309 A1 Oct. 4, 2012

(30) Foreign Application Priority Data

Mar. 28, 2011 (JP) ..... 2011-070416

(51) Int. Cl.
*G10H 1/00* (2006.01)

(52) U.S. Cl. ..... 84/626; 84/625; 84/630; 84/660; 84/662

(58) Field of Classification Search ..... 84/625, 84/626, 630, 660, 662
See application file for complete search history.

(56) References Cited

U.S. PATENT DOCUMENTS

| | | | | |
|---|---|---|---|---|
| 3,505,461 | A * | 4/1970 | Omura et al. | 84/698 |
| 3,539,698 | A * | 11/1970 | Omura et al. | 84/697 |
| 3,708,602 | A * | 1/1973 | Hiyama | 84/699 |
| 3,809,791 | A * | 5/1974 | Uchiyama | 84/675 |
| 3,842,205 | A * | 10/1974 | Okamoto | 381/62 |
| 3,939,751 | A * | 2/1976 | Harasek | 84/721 |
| 4,909,121 | A * | 3/1990 | Usa et al. | 84/606 |
| 5,463,184 | A * | 10/1995 | Kawamura | 84/719 |
| 5,498,834 | A * | 3/1996 | Inagaki et al. | 84/622 |
| 5,648,629 | A * | 7/1997 | Kozuki | 84/660 |

FOREIGN PATENT DOCUMENTS

JP 2004-213050 A 7/2004

* cited by examiner

*Primary Examiner* — David S. Warren
(74) *Attorney, Agent, or Firm* — Birch, Stewart, Kolasch & Birch, LLP

(57) ABSTRACT

A piano with an electronic tone generator capable of outputting musical sound signals of a reverberation and/or a resonance, in accordance with whether an external output is performed or not.

2 Claims, 2 Drawing Sheets

PIANO WITH ELECTRONIC TONE GENERATOR

CROSS-REFERENCE TO RELATED APPLICATION

This application is based upon and claims the benefit of priority of the prior Japanese Patent Application No. 2011-070416, filed on Mar. 28, 2011, the entire contents of which are incorporated herein by reference.

BACKGROUND OF THE INVENTION

1. Field of the Invention

The present invention relates to a piano with an electronic tone generator.

2. Description of the Related Art

A piano with an electronic tone generator can generate a musical sound signal using the electronic tone generator. Further, the piano with the electronic tone generator can generate musical sound signals of a reverberation and a resonance. A type and a degree of intensity of the reverberation and the resonance can be specified through operation of operation elements.

Further, an electronic musical instrument that reads a key depression waveform in accordance with a key depression signal indicating a key depression, and reads a resonant waveform based on a pedal-on signal indicating that a pedal is depressed, has been known (refer to Patent Document 1, for example).

[Patent Document 1] Japanese Laid-open Patent Publication No. 2004-213050

The presence/absence of the reverberation and the resonance generated by the electronic tone generator is specified by the operation of the operation element. However, when the reverberation and the resonance are not required, it is desired to automatically turn off the reverberation and the resonance.

SUMMARY OF THE INVENTION

An object of the present invention is to provide a piano with an electronic tone generator capable of outputting musical sound signals of a reverberation and/or a resonance, in accordance with whether an external output is performed or not.

A piano with an electronic tone generator of the present invention is characterized in that it includes: a touch sensor detecting a key depression operation of a key of a keyboard; a soundboard generating a sound by vibration; a vibrator giving vibration to the soundboard based on a musical sound signal; a detector detecting whether or not the musical sound signal is externally output; a normal sound generator generating a musical sound signal of a normal sound in response to the key depression operation detected by the touch sensor; a sound effect generator generating a musical sound signal of sound effect including a reverberation and/or a resonance, in response to the key depression operation detected by the touch sensor; and an output control unit externally outputting, when the detector detects that the musical sound signal is externally output, a signal as a result of performing mixing of the musical sound signal of the normal sound generated by the normal sound generator and the musical sound signal of the sound effect generated by the sound effect generator, and outputting, when the detector detects that the musical sound signal is not externally output, the musical sound signal of the normal sound generated by the normal sound generator to the vibrator, without outputting the musical sound signal of the sound effect generated by the sound effect generator to the vibrator.

DETAILED DESCRIPTION OF THE PREFERRED EMBODIMENTS (First Embodiment)

Figure 1:
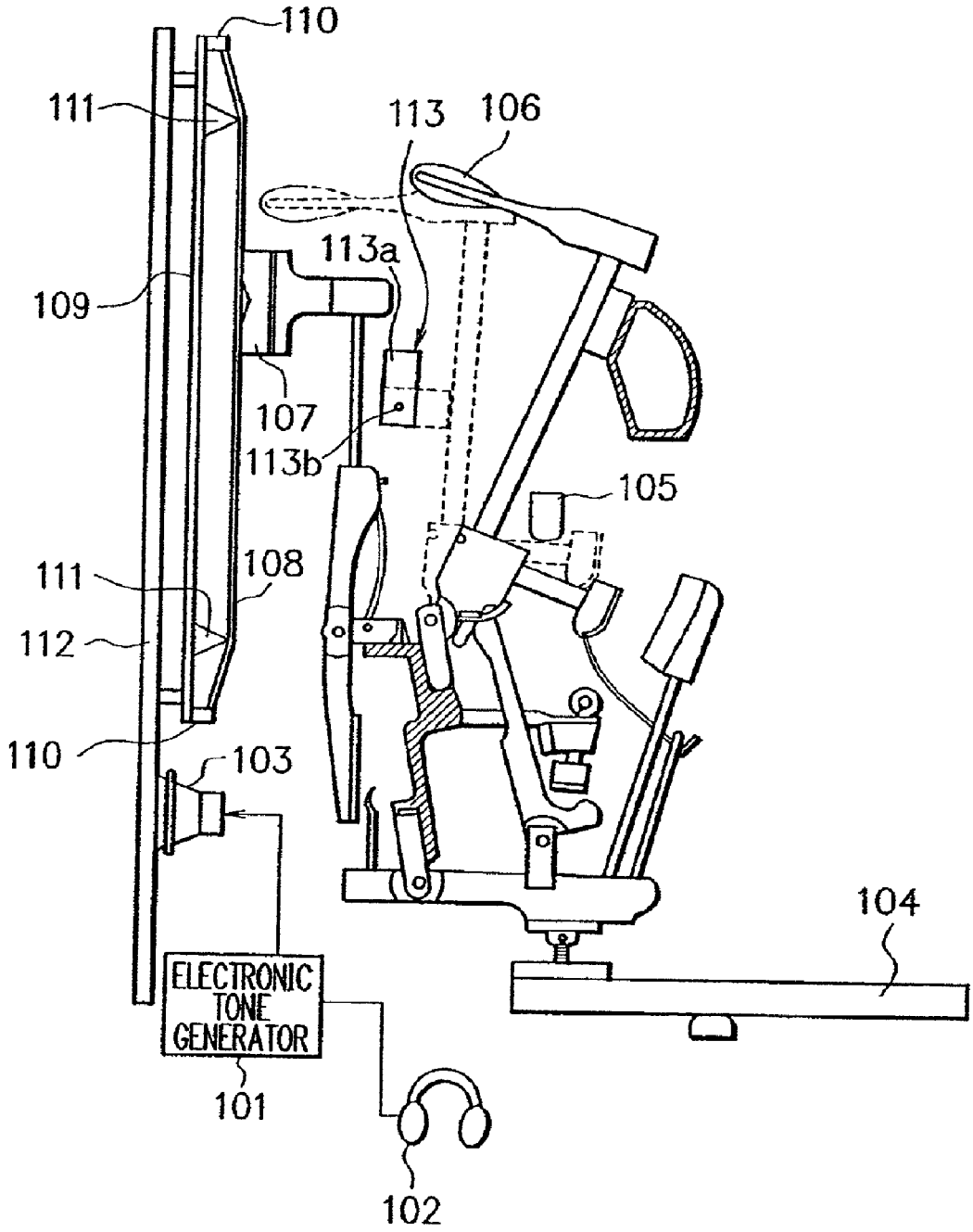
FIG. 1 is a diagram illustrating a configuration example of a piano with an electronic tone generator according to a first embodiment of the present invention.

FIG. 1 is a diagram illustrating a configuration example of a piano with an electronic tone generator according to a first embodiment of the present invention. A performer can switch between a normal performance mode and a silent performance mode by operating a mute operation element. Regarding a stopper 113, a main body portion 113*a* is pivotally supported by a fulcrum 113*b* through a driving of a motor. The motor is driven by an electronic tone generator 101. First, the normal performance mode will be described. When a key 104 of a keyboard is depressed, a hammer 106 strikes a string 108 to generate a sound. At this time, the stopper 113 illustrated by a solid line in FIG. 1 does not restrain a movement of the hammer 106, so that the string 108 can be vibrated. The string 108 is supported by a frame 109 with the use of bridges 111 and pins 110. The frame 109 is fixed to a soundboard 112. When the string 108 is struck by the hammer 106, the string 108 is vibrated, resulting in that a normal sound is generated. The sound reflects inside the piano, and the reflected sound vibrates the soundboard 112, resulting in that a reverberation is generated. Further, the string 108 vibrates by being resonant with the generated sound, resulting in that a resonance is generated. When the key 104 of the keyboard is released, a dumper 107 is brought into contact with the string 108, which suppresses the vibration of the string 108 to mute the sound.

Next, the silent performance mode will be described. In the silent performance mode, the stopper 113 illustrated by a dotted line in FIG. 1 restrains the movement of the hammer 106. As a result of this, even when the key 104 of the keyboard is depressed, the hammer 106 is not brought into contact with the string 108, and no sound is generated. At this time, the electronic tone generator 101 can generate a musical sound signal, and to selectively output the signal to a headphone 102 or a vibrator 103. A touch sensor 105 detects a key depression operation including pitch information and a key release operation of the key 104 of the keyboard. The electronic tone generator 101 generates a musical sound signal in response to the key depression operation detected by the touch sensor 105. When the headphone 102 is inserted into a headphone terminal of the piano, the electronic tone generator 101 outputs the generated musical sound signal to the headphone 102. The headphone 102 generates a sound in accordance with the musical sound signal. At this time, the electronic tone generator 101 can generate, in addition to the musical sound signal of the normal sound described above, musical sound signals of the above-described reverberation and resonance. Accordingly, the electronic tone generator 101 can generate the musical sound signals imitating the normal sound, the reverberation and the resonance of acoustic piano.

When the headphone 102 is not inserted into the headphone terminal of the piano, the electronic tone generator 101 outputs the generated musical sound signal to the vibrator 103. The vibrator 103 gives vibration to the soundboard 112 based on the musical sound signal. The soundboard 112 generates the normal sound by the vibration. The generated sound reflects inside the piano, and the reflected sound vibrates the soundboard 112, resulting in that the reverberation is generated, similar to the above description. Further, the string 108 vibrates by being resonant with the generated sound, resulting in that the resonance is generated. Therefore, the electronic tone generator 101 is only required to output only the musical sound signal of the normal sound to the vibrator 103, and is not required to output the musical sound signals of the reverberation and the resonance to the vibrator 103.

When, tentatively, in a case where the electronic tone generator 101 outputs the musical sound signal to the vibrator 103, the electronic tone generator 101 outputs the musical sound signals of the reverberation and the resonance, in addition to the musical sound signal of the normal sound to the vibrator 103, similar to the case of outputting the musical sound signals to the headphone 102, both of the reverberation and the resonance are doubly generated, resulting in that improper sounds are generated.

In the present embodiment, when the headphone 102 is inserted into the headphone terminal of the piano, the electronic tone generator 101 outputs the musical sound signals of the reverberation and/or the resonance, in addition to the musical sound signal of the normal sound, to the headphone 102. On the contrary, when the headphone 102 is not inserted into the headphone terminal of the piano, the electronic tone generator 101 outputs only the musical sound signal of the normal sound to the vibrator 103, and it does not output the musical sound signals of the reverberation and the resonance to the vibrator 103. Accordingly, it is possible to generate proper sounds in accordance with the presence/absence of the use of the headphone 102.

Further, by operating a volume control element, the performer can adjust a volume of the musical sound signal generated by the electronic tone generator 101. The performer can generate a musical sound with a desired small volume in the night, for example, by using the electronic tone generator 101.

Figure 2:
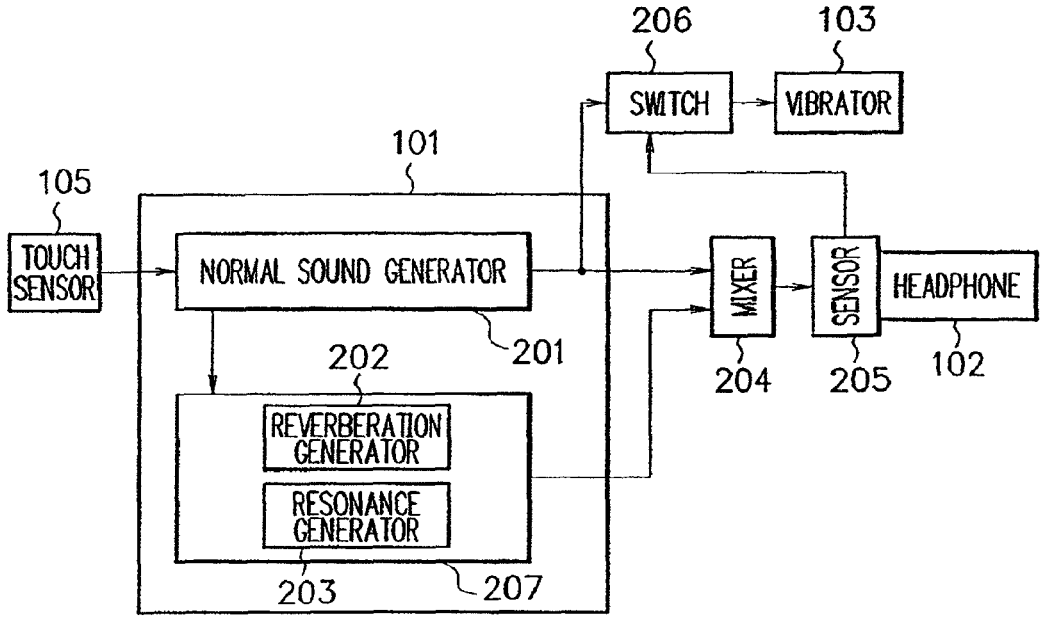
FIG. 2 is a block diagram illustrating a more concrete configuration example of a part of the piano with the electronic tone generator in FIG. 1.

FIG. 2 is a block diagram illustrating a more concrete configuration example of a part of the piano with the electronic tone generator in FIG. 1. When the touch sensor 105 detects the key depression operation or the key release operation of the key 104 of the keyboard, it outputs key depression information including the pitch or key release information to the electronic tone generator 101. The electronic tone generator 101 has a normal sound generator 201 and a sound effect generator 207. The sound effect generator 207 has a reverberation generator 202 and a resonance generator 203. The normal sound generator 201 generates the musical sound signal of the normal sound in response to the key depression operation detected by the touch sensor 105. The reverberation generator 202 inputs the musical sound signal of the normal sound therein, and generates the musical sound signal of the reverberation in response to the key depression operation detected by the touch sensor 105. The resonance generator 203 inputs the musical sound signal of the normal sound therein, and generates the musical sound signal of the resonance in response to the key depression operation detected by the touch sensor 105.

Note that the sound effect generator 207 does not necessarily have to have both of the reverberation generator 202 and the resonance generator 203, and it may also be structured to have either one of the generators. Specifically, the sound effect generator 207 inputs the musical sound signal of the normal sound therein, and generates the musical sound signal of the sound effect including the reverberation and/or the resonance in response to the key depression operation detected by the touch sensor 105.

A mixer 204 performs mixing of the musical sound signal of the normal sound generated by the normal sound generator 201 and the musical sound signal of the sound effect generated by the sound effect generator 207, and outputs the resultant to the headphone terminal (external output terminal) of the piano. When the headphone 102 is inserted into the headphone terminal (external output terminal) of the piano, the headphone 102 inputs the musical sound signal output from the mixer 204 therein, and generates the normal sound and the sound effect based on the musical sound signal.

An output terminal of the normal sound generator 201 is input into the vibrator 103 via a switch 206. A sensor 205 is a detector that detects whether or not the headphone 102 is inserted into the headphone terminal (external output terminal) of the piano. When the sensor 205 detects that the headphone 102 is inserted into the terminal, it turns off the switch 206, and when it does not detect that the headphone 102 is inserted into the terminal, it turns on the switch 206.

When the headphone 102 is inserted into the terminal, the switch 206 is turned off, and the vibrator 103 does not input the musical sound signal therein from the normal sound generator 201 and does not give vibration to the soundboard 112, resulting in that the soundboard 112 does not generate a sound. On the contrary, when the headphone 102 is not inserted into the terminal, the switch 206 is turned on, and the vibrator 103 inputs the musical sound signal of the normal sound therein from the normal sound generator 201, and gives vibration to the soundboard 112 based on the musical sound signal of the normal sound. Accordingly, the soundboard 112 generates the normal sound. Further, the normal sound reflects inside the piano, and the reflected sound makes the soundboard 112 generate the reverberation. Further, the string 108 vibrates by being resonant with the generated sound, resulting in that the resonance is generated.

An output control unit having the switch 206 outputs, when the sensor 205 detects that the headphone 102 is inserted into the terminal, a signal as a result of performing mixing of the musical sound signal of the normal sound generated by the normal sound generator 201 and the musical sound signal of the sound effect generated by the sound effect generator 207 to the headphone 102, and outputs, when the sensor 205 does not detect that the headphone 102 is inserted into the terminal, the musical sound signal of the normal sound generated by the normal sound generator 201 to the vibrator 103, without outputting the musical sound signal of the sound effect generated by the sound effect generator 207 to the vibrator 103.

As described above, when the vibration is given to the soundboard 112 by the vibrator 103, the reverberation and/or the resonance are/is generated due to an acoustic effect inside the piano, so that there is no need to output the musical sound signals of the reverberation and/or the resonance to the vibrator 103. When the musical sound signal of the normal sound is output to the vibrator 103, the musical sound signals of the reverberation and the resonance are not output to the vibrator 103, so that it is possible to generate proper reverberation and/or resonance.

(Second Embodiment)

Figure 3:
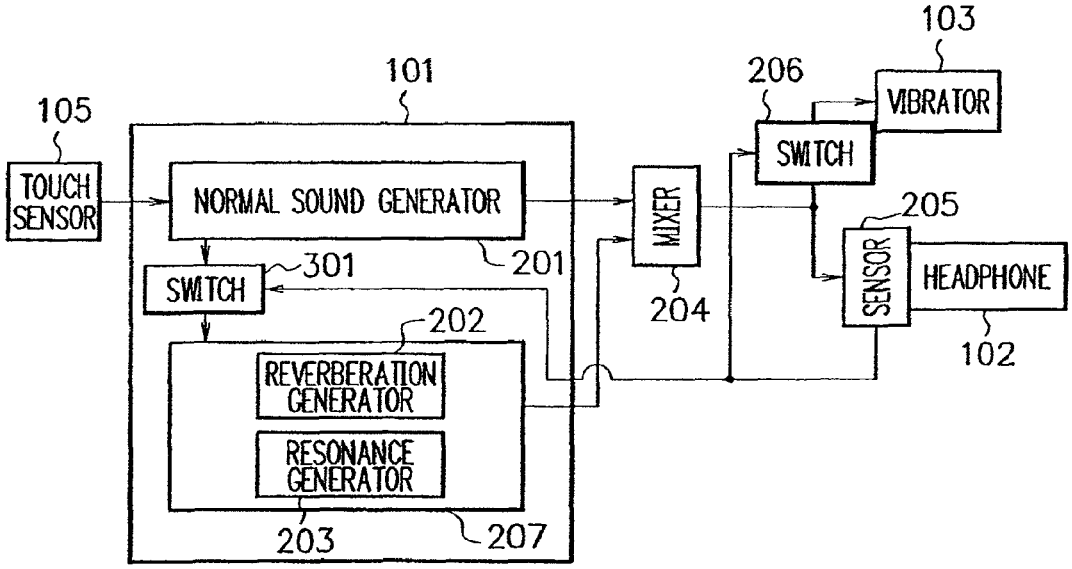
FIG. 3 is a block diagram illustrating a configuration example of a part of a piano with an electronic tone generator according to a second embodiment of the present invention.

FIG. 3 is a block diagram illustrating a configuration example of a part of a piano with an electronic tone generator according to a second embodiment of the present invention. FIG. 3 corresponds to FIG. 2, and is a block diagram illustrating a more concrete configuration example of a part of the piano with the electronic tone generator in FIG. 1. FIG. 3 corresponds to FIG. 2 to which a switch 301 is added. Hereinafter, a point at which the present embodiment is different from the first embodiment will be described. The sound effect generator 207 inputs the musical sound signal of the normal sound therein from the normal sound generator 201 via the switch 301. The vibrator 103 inputs an output signal of the mixer 204 therein via the switch 206.

When the sensor 205 detects that the headphone 102 is inserted into the headphone terminal of the piano, it turns off the switch 206, and turns on the switch 301. When the switch 301 is turned on, the sound effect generator 207 inputs the musical sound signal of the normal sound therein from the normal sound generator 201, and generates the musical sound signal of the sound effect including the reverberation and/or the resonance in response to the key depression operation detected by the touch sensor 105. The mixer 204 performs mixing of the musical sound signal of the normal sound generated by the normal sound generator 201 and the musical sound signal of the sound effect generated by the sound effect generator 207, and outputs the resultant to the headphone terminal (external output terminal) of the piano. The headphone 102 is connected to the headphone terminal of the piano, so that it generates the normal sound and the sound effect based on the musical sound signal output from the mixer 204. Further, since the switch 206 is turned off, the vibrator 103 does not input the musical sound signal therein from the mixer 204, and does not give vibration to the soundboard 112. Therefore, the soundboard 112 does not generate a sound.

On the contrary, when the sensor 205 does not detect that the headphone 102 is inserted into the headphone terminal of the piano, it turns on the switch 206, and turns off the switch 301. When the switch 301 is turned off, the sound effect generator 207 does not input the musical sound signal of the normal sound therein from the normal sound generator 201, and does not generate the musical sound signal of the sound effect. Therefore, the mixer 204 outputs the musical sound signal of the normal sound generated by the normal sound generator 201 as it is. Since the switch 206 is turned on, the vibrator 103 inputs the musical sound signal of the normal sound therein from the mixer 204, and gives vibration to the soundboard 112. Accordingly, the soundboard 112 generates the normal sound. Further, the normal sound reflects inside the piano, and the reflected sound makes the soundboard 112 generate the reverberation. Further, the string 108 vibrates by being resonant with the generated sound, resulting in that the resonance is generated.

The output control unit having the switches 206 and 301 outputs, when the sensor 205 detects that the headphone 102 is inserted into the terminal, a signal as a result of performing mixing of the musical sound signal of the normal sound generated by the normal sound generator 201 and the musical sound signal of the sound effect generated by the sound effect generator 207 to the headphone 102, and outputs, when the sensor 205 does not detect that the headphone 102 is inserted into the terminal, the musical sound signal of the normal sound generated by the normal sound generator 201 to the vibrator 103, without outputting the musical sound signal of the sound effect generated by the sound effect generator 207 to the vibrator 103.

Note that in the first and second embodiments, explanation was made by citing a case where the headphone 102 is inserted into the headphone terminal (external output terminal) of the piano, as an example, but, the present invention is not limited to the case. The present invention can also be applied to a case where an external speaker or the like, instead of the headphone 102, is connected to the external output terminal of the piano. In that case, it is only required that the sensor 205 detects whether or not the external speaker or the like is connected to the external output terminal, and controls the switch(es) 206 and/or 301.

Specifically, the sensor 205 is a detector that detects whether or not the musical sound signal is externally output. The output control unit having the switch(es) 206 and/or 301 externally outputs, when the sensor 205 detects that the musical sound signal is externally output, a signal as a result of performing mixing of the musical sound signal of the normal sound generated by the normal sound generator 201 and the musical sound signal of the sound effect generated by the sound effect generator 207, and outputs, when the sensor 205 detects that the musical sound signal is not externally output, the musical sound signal of the normal sound generated by the normal sound generator 201 to the vibrator 103, without outputting the musical sound signal of the sound effect generated by the sound effect generator 207 to the vibrator 103.

As described above, when the vibration is given to the soundboard 112 by the vibrator 103, the reverberation and/or the resonance are/is generated due to an acoustic effect inside the piano, so that there is no need to output the musical sound signals of the reverberation and/or the resonance to the vibrator 103. When the musical sound signal of the normal sound is output to the vibrator 103, the musical sound signals of the reverberation and the resonance are not output to the vibrator 103, so that it is possible to generate proper reverberation and/or resonance.

When the vibration is given to the soundboard by the vibrator, the reverberation and/or the resonance are/is generated due to an acoustic effect inside the piano, so that there is no need to output the musical sound signals of the reverberation and/or the resonance to the vibrator. When the musical sound signal of the normal sound is output to the vibrator, the musical sound signals of the reverberation and the resonance are not output to the vibrator, so that it is possible to generate proper reverberation and/or resonance.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A piano with an electronic tone generator, comprising:

a touch sensor detecting a key depression operation of a key of a keyboard;

a soundboard generating a sound by vibration;

a vibrator giving vibration to said soundboard based on a musical sound signal;

a detector detecting whether or not the musical sound signal is externally output;

a normal sound generator generating a musical sound signal of a normal sound in response to the key depression operation detected by said touch sensor;

a sound effect generator generating a musical sound signal of sound effect including a reverberation and/or a resonance, in response to the key depression operation detected by said touch sensor; and an output control unit externally outputting, when said detector detects that the musical sound signal is externally output, a signal as a result of performing mixing of the musical sound signal of the normal sound generated by said normal sound generator and the musical sound signal of the sound effect generated by said sound effect generator, and outputting, when said detector detects that the musical sound signal is not externally output, the musical sound signal of the normal sound generated by said normal sound generator to said vibrator, without outputting the musical sound signal of the sound effect generated by said sound effect generator to said vibrator.

2. The piano with the electronic tone generator according to claim 1, wherein:

said detector detects whether or not a headphone is inserted into a terminal for the external output; and said output control unit outputs, when said detector detects that the headphone is inserted into the terminal, a signal as a result of performing mixing of the musical sound signal of the normal sound generated by said normal sound generator and the musical sound signal of the sound effect generated by said sound effect generator to the headphone, and outputs, when said detector does not detect that the headphone is inserted into the terminal, the musical sound signal of the normal sound generated by said normal sound generator to said vibrator, without outputting the musical sound signal of the sound effect generated by said sound effect generator to said vibrator.

* * * * *